US009120642B2

(12) United States Patent
Fujihata

(10) Patent No.: US 9,120,642 B2
(45) Date of Patent: Sep. 1, 2015

(54) ELEVATOR CONTROL DEVICE

(75) Inventor: Yuji Fujihata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 511 days.

(21) Appl. No.: 13/640,402

(22) PCT Filed: Jun. 29, 2010

(86) PCT No.: PCT/JP2010/061012

§ 371 (c)(1),
(2), (4) Date: Oct. 10, 2012

(87) PCT Pub. No.: WO2012/001764

PCT Pub. Date: Jan. 5, 2012

(65) Prior Publication Data

US 2013/0025973 A1 Jan. 31, 2013

(51) Int. Cl.
*B66B 1/20* (2006.01)
*B66B 5/02* (2006.01)

(52) U.S. Cl.
CPC ..... *B66B 5/022* (2013.01); *B66B 5/024* (2013.01)

(58) Field of Classification Search
CPC ..... B66B 5/022; B66B 5/024
USPC ..... 187/247, 248, 313, 316, 317, 380–389, 187/391–393, 396
See application file for complete search history.

(56) References Cited

U.S. PATENT DOCUMENTS 7,210,564 B2 * 5/2007 Kawai ..... 187/384
7,461,723 B2 * 12/2008 Kawai ..... 187/313
7,621,378 B2 * 11/2009 Kawai ..... 187/313
7,677,363 B2 * 3/2010 Kawai ..... 187/387
7,938,232 B2 * 5/2011 Hikita et al. ..... 187/384

(Continued)

FOREIGN PATENT DOCUMENTS

JP 53 120060 9/1978
JP 2006 193296 7/2006

(Continued)

OTHER PUBLICATIONS

International Search Report Issued Feb. 8, 2011 in PCT/JP10/61012 Filed Jun. 29, 2010.

(Continued)

*Primary Examiner* — Anthony Salata
(74) *Attorney, Agent, or Firm* — Oblon, McClelland, Maier & Neustadt, L.L.P.

(57) ABSTRACT

An elevator control device includes a control device body controlling operation of one or more elevators operated between plural floors of a building, and carries out emergency evacuation operation for evacuating people by using an elevator when the building suffers from fire, earthquake, or the like. The elevator control device includes a damage detector that detects damage due to disaster at each floor and outputs the detected damage as damage information of each floor; and a person detector that detects the number and positions of persons present at each floor and outputs these data as person number and position information, and in the emergency evacuation operation, the elevator control device body develops an elevator evacuation operation plan based on the position of the elevator car, the damage information, and the person number and position information, and controls the operation of elevator based on the developed evacuation operation plan.

8 Claims, 2 Drawing Sheets

(56) References Cited

U.S. PATENT DOCUMENTS

| | | | | |
|---|---|---|---|---|
| 8,763,761 | B2 * | 7/2014 | Siikonen | 187/384 |
| 8,839,914 | B2 * | 9/2014 | Iwata et al. | 187/384 |
| 2008/0196979 | A1 | 8/2008 | Sakurai | |

FOREIGN PATENT DOCUMENTS

| | | | |
|---|---|---|---|
| JP | 2007 131362 | | 5/2007 |
| JP | 2008 308309 | | 12/2008 |
| KR | 10-2008-0047405 | | 5/2008 |
| KR | 10-2009-0086966 | | 8/2009 |
| WO | WO 2007/066390 | A1 | 6/2007 |
| WO | 2008 107952 | | 9/2008 |

OTHER PUBLICATIONS

Korean Office Action issued Aug. 19, 2013, in Korea Patent Application No. 10-2012-7007191 (with English translation).

English Translation of the International Preliminary Examination Report on Patentability with Written Opinion issued on Jan. 24, 2013 in PCT/JP2010/061012 filed on Jun. 29, 2010.

* cited by examiner

ELEVATOR CONTROL DEVICE

TECHNICAL FIELD

The present invention relates to an elevator control device.

BACKGROUND ART

For some conventional elevator control devices, when a disaster such as fire or earthquake occurs in a building in which an elevator is installed, control operation is carried out to evacuate people present in the building. For such an elevator control device, based on the information concerning the number of persons present in the building and the floor on which a fire or the like occurs (the place of occurrence), emergency operation is carried out by selecting an evacuation floor and by determining the sequential order of floors to which the elevator is operated.

As the conventional elevator control device of this type, the elevator control devices described, for example, in Patent Literature 1 and Patent Literature 2 have been known. For the elevator control device described in Patent Literature 1, based on the number of elevator boarding and alighting persons at each floor of the building and the number of persons who move in passages connecting the floors to each other, the increase and decrease in the number of boarding and alighting persons and the number of moving persons are calculated, and the number of staying persons at each floor is estimated. Based on the estimated number of persons staying at each floor and the information concerning the floor on fire outputted from a fire detector, the evacuation floor is determined.

For the elevator control device described in Patent Literature 2, based on the information concerning the presence and absence of people on each floor and the information concerning the occurrence of fire, the elevator is operated to the floor on which people are present in the order in which the floor on fire is made a first priority floor, the upper floor next to the floor on fire is made a second priority floor, and the lower floor next to the floor on fire is made a third priority floor. When fire environmental information exceeding a safety tolerance value is outputted from a floor that is not set in that order before the finish of elevator operation according to that order, the floor from which the fire environmental information is Outputted is reset to be the first priority floor, and the elevator is operated according to the new order.

CITATION LIST

Patent Literature

Patent Literature 1: Japanese Patent Laid-Open No. 2006-193296

Patent Literature 2: Japanese Patent Laid-Open No. 2008-308309

SUMMARY OF INVENTION

Technical Problem

Unfortunately, for the conventional elevator control devices described in Patent Literature 1 and Patent Literature 2, (the order of) the floor to which the elevator car is run is determined without considering the present position of the elevator car and the time period necessary for the people who are present on the evacuation floor such as the floor on fire to arrive at the elevator hall when the emergency evacuation operation is carried out at the time of fire occurrence.

Therefore, depending on the present position of the car and the position of person on the evacuation floor, the standby of the car may occur because the evacuating person does not arrive at the hall despite the fact that the car has arrived at the evacuation floor, or inversely, the person on the evacuation floor who has arrived at the hall may have to wait the arrival of the car. This presents a problem that in the emergency evacuation operation at the time of disaster occurrence, the car cannot necessarily be run optimally (for example, so as to finish the evacuation of people to be evacuated in the shortest time period).

The present invention has been made to solve the above problem, and accordingly an object thereof is to provide an elevator control device capable of operating (the car of) an elevator optimally in emergency evacuation operation at the time of disaster occurrence.

Means for Solving the Problems

An elevator control device according to the present invention, which has a control device body for controlling the operation of one or more elevators operated between a plurality of floors of a building, and carries out emergency evacuation operation for evacuating the people in the building by using the elevator when the building suffers from fire, earthquake, or the like, comprises: a damage detector which detects damage due to disaster at each floor and outputs the detected damage as damage information of each floor; and a person detector which detects the number of persons present at each floor and the position of the person and outputs these pieces of data as person number and position information, and in the emergency evacuation operation, the elevator control device body develops an elevator evacuation operation plan on the basis of the position of the elevator car, the damage information, and the person number and position information, and controls the operation of elevator on the basis of the developed evacuation operation plan.

Advantageous Effect of Invention

The elevator control device in accordance with the present invention achieves an effect of being capable of operating (the car of) an elevator optimally in the emergency evacuation operation at the time of disaster occurrence.

DESCRIPTION OF EMBODIMENT

First Embodiment

Figure 1:
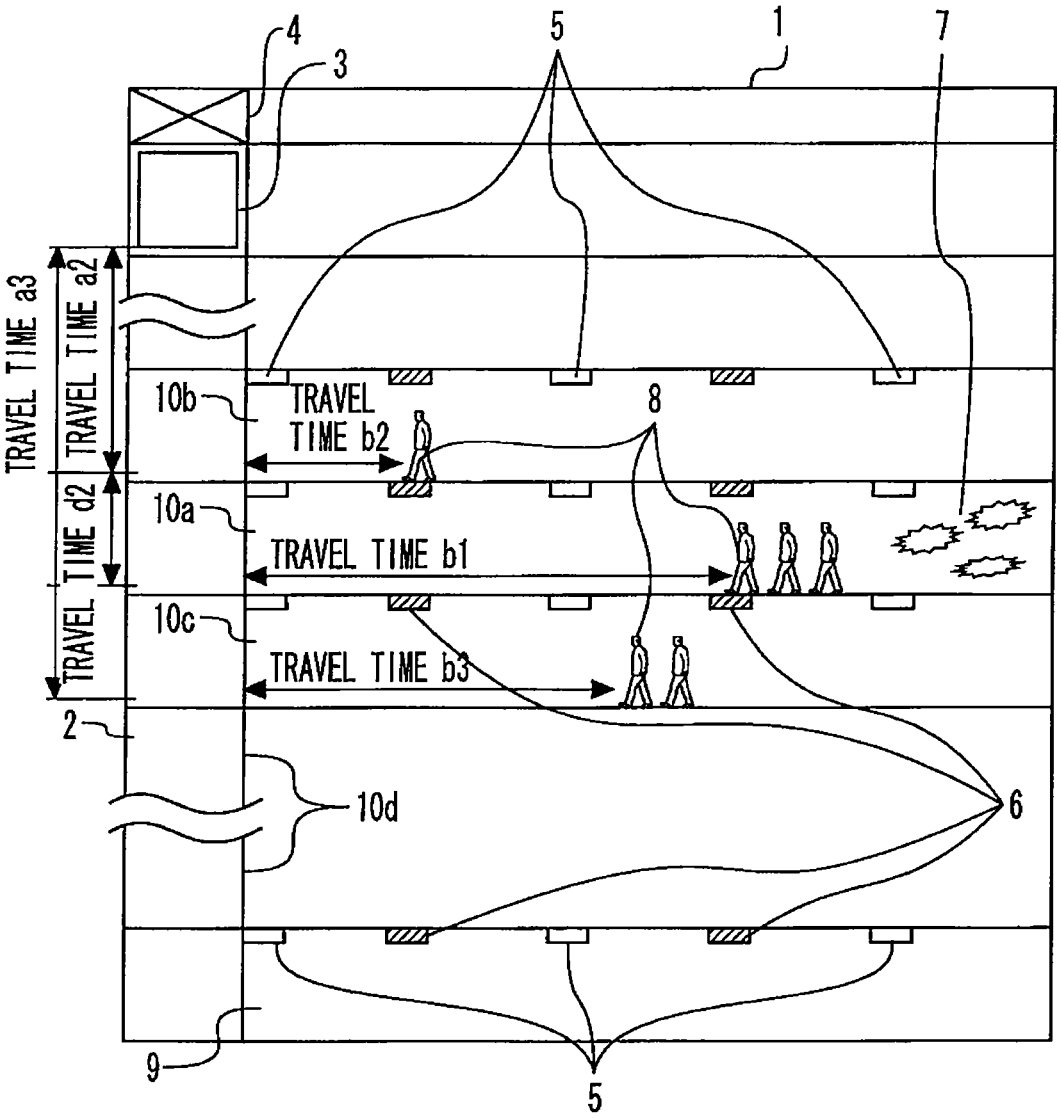
FIG. 1 is a schematic view showing the general configuration of an elevator related to first embodiment of the present invention.

FIG. 1, which relates to a first embodiment of the present invention, is a schematic view showing the general configuration of an elevator. In FIG. 1, reference sign 1 denotes a building in which the elevator is installed. This building 1 has a plurality of floors. This building 1 is provided with an elevator for carrying persons and articles between the plurality of floors. That is, a shaft 2 is provided so as to vertically penetrate the plurality of floors of the building 1, and in this shaft 2, a car 3 that runs while being loaded with persons and articles is disposed so as to be movable up and down.

The whole of elevator operation including the running of the car 3 is controlled by an elevator control device body 4. This elevator control device body 4 controls the operation mode of elevator. At the normal time when no disaster occurs, the operation mode is a normal operation mode. When the occurrence of disaster such as fire or earthquake is detected, the elevator control device body 4 transfers the operation mode to various emergency control operation modes according to the kind of disaster occurred or an evacuation operation mode in which the emergency evacuation operation is carried out to evacuate the people in the building. In this embodiment, the elevator control device body 4 is installed, for example, in a machinery room provided in the top portion of the shaft 2.

On each of the floors of the building 1, a fire detector 5 for detecting the fire occurrence at that floor is provided. The fire detector 5 is provided in plural numbers as necessary so that the entire region of floor is made the detection range. The fire detector 5 on each floor outputs a detection result as three stages of damage level according to the scale, situation, and the like of fire detected on each floor. The information concerning the damage level is outputted from the fire detector 5 at every predetermined time intervals.

The damage levels of three stages outputted from the fire detector 5 are as described below. First, the first level is a damage level at the initial stage, at which the damage is the slightest. Next, the second level is a damage level at which the people must get away urgently, and is a damage level at which the damage is more serious than the damage at the first level and slighter than the damage at the third level. The third level is a damage level at which the people cannot get away by using the elevator, and is a damage level at which the damage is the most serious. The fire detector 5 may be an apparatus configured so that the damage situation of each floor can be confirmed by combinedly using a surveillance camera.

On each of the floors of the building 1, a person detector 6 for detecting the person who is present at that floor is provided. Like the fire detector 5, the person detector 6 is also provided in plural numbers as necessary so that the entire region of floor is made the detection range. The person detector 6 can detect the presence and absence of person at the floor, can count the number of persons in the case of the presence of person, and can detect the position at which the person is present. The person detector 6 outputs information concerning the presence and absence of person at the floor, the number of persons, and the position of the person. Like the fire detector 5, these pieces of information are outputted at every predetermined time intervals. The person detector 6 may be an apparatus configured so as to detect the presence and absence of person at the floor, the number of persons, and the position of the person by receiving a signal sent from a wireless transmitter carried by the person at the floor.

When receiving, from the fire detector 5, damage information that a fire 7 having occurred in the building 1 has been detected, the elevator control device body 4 transfers the elevator operation mode to the evacuation operation mode. In the evacuation operation mode, based on the damage level of each floor outputted from the fire detector 5, the elevator control device body 4 determines the order of precedence of arrival of the car 3 to each floor. At this time, a floor the damage level of which is the second level is given priority, being the high-level order of precedence of arrival.

Next, the elevator control device body 4 acquires the present position of the car 3, and calculates travel time period necessary for the car 3 to move from the present position to each floor of the building 1 with respect to every floor. Also, based on the information concerning the presence and absence of person at each floor, the number of persons, and the position of the person outputted from the person detector 6, the elevator control device body 4 calculates travel time period necessary for a person (an evacuee 8) at each floor to move to the elevator hall of that floor and boarding time period necessary for the evacuee 8 to get into the car 3 from the hall when the car 3 arrives at that floor.

Based on the before-determined order of precedence of arrival of the car 3 at each floor, the calculated travel time period of the car 3 to each floor, the travel time period of the evacuee 8 to the hall on each floor, and the boarding time period of the evacuee 8 into the car 3, the elevator control device body 4 establishes an evacuation operation plan including the order of arrival of the car 3 at each floor so that the plan is optimal for the evacuee 8 at each floor to be carried to an escape floor 9 (so that all evacuees 8 can be carried to the escape floor 9 in the shortest time period). The elevator control device body 4 carries the evacuee 8 to the escape floor 9 by controlling the running of the car 3 pursuant to the established evacuation operation plan.

Figure 2:
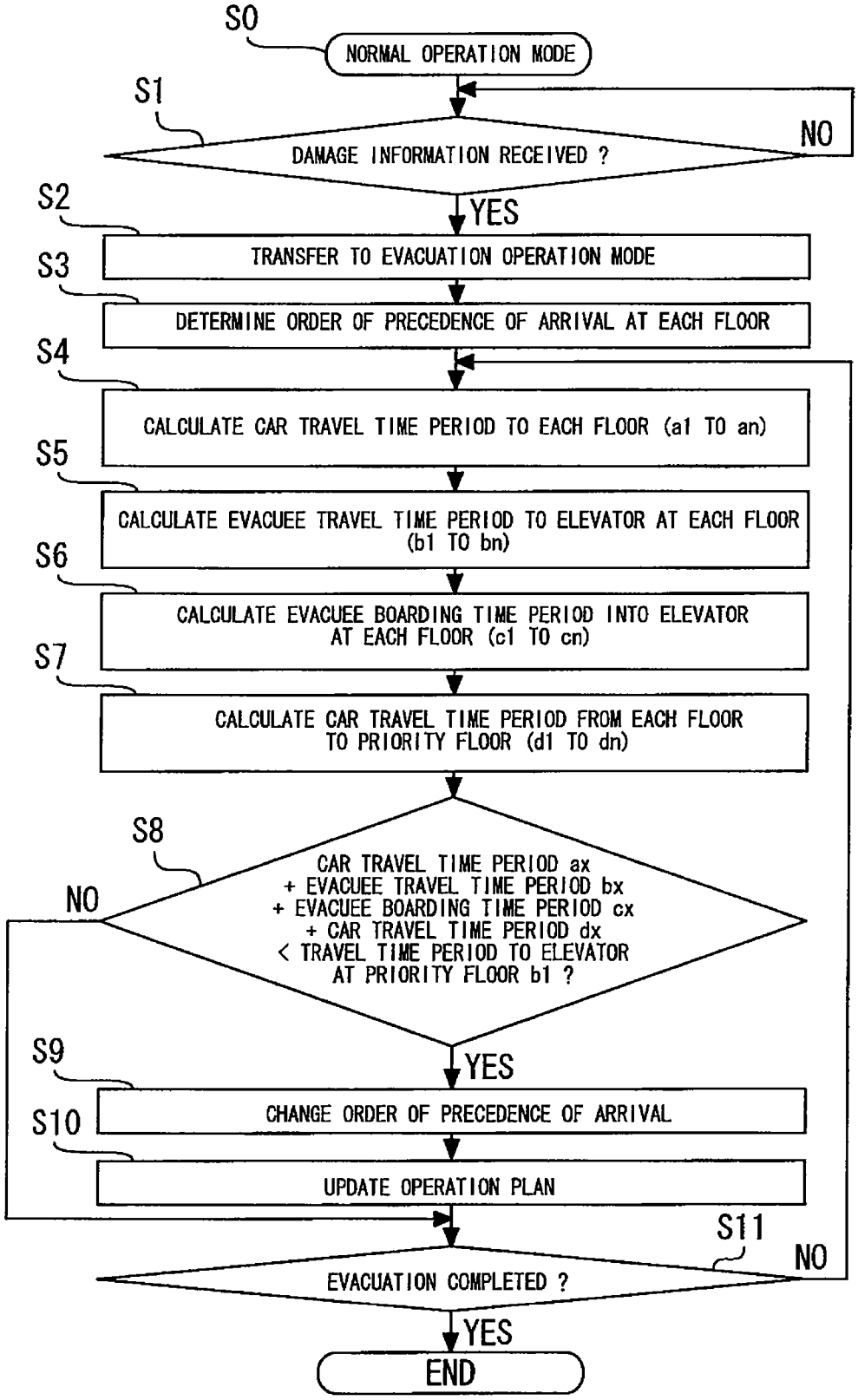
FIG. 2 is a flowchart showing the operations of the elevator control device related to first embodiment of the present invention.

FIG. 2 is a flowchart showing the operations of the elevator control device in this embodiment.

First, when the elevator operation mode is the normal operation mode (Step S0), the elevator control device body 4 makes a check whether or not the damage information that the fire 7 having occurred in the building 1 has been detected, which information is outputted from the fire detector 5, has been received (Step S1). In Step S1, if it is checked that the damage information outputted from the fire detector 5 has been received, the process proceeds to Step S2. On the other hand, if it is checked that the damage information outputted from the fire detector 5 has not been received, the check in Step S1 is repeated until the receipt of damage information is checked.

In Step S2, the elevator control device body 4 transfers the elevator operation mode to the evacuation operation mode. Then, the process proceeds to Step S3, where the elevator control device body 4 determines the order of precedence of arrival of the car 3 at each floor based on the damage level of each floor outputted from the fire detector 5. After Step S3, the process proceeds to Step S4. In Step S4, the elevator control device body 4 first acquires the present position of the car 3. Then, the elevator control device body 4 calculates the travel time period during which the car 3 moves from the acquired present position to each floor.

Taking the number of floors that the building 1 has as n (n is a natural number not less than 2), the numbers of 1 to n are allocated to the floors in the order of precedence of arrival determined in Step S3. In this example, it is assumed that the first order of precedence of arrival is a disaster-stricken floor 10*a*, which is a floor on which the fire 7 has occurred, the second order of precedence of arrival is an upper floor 10*b* next to the disaster-stricken floor 10*a*, the third order of precedence of arrival is a lower floor 10*c* next to the disaster-stricken floor 10*a*, and the fourth to n-th orders of precedence of arrival are other remaining floors 10*d*.

After the numbers of 1 to n have been allocated to the floors, the travel time period during which the car 3 moves from the present position to the disaster-stricken floor 10*a*, which has been calculated in Step S4, is taken as a1, the travel time period during which the car 3 moves to the upper floor 10*b* next to the disaster-stricken floor 10*a* is taken as a2, the travel time period during which the car 3 moves to the lower floor 10*c* next to the disaster-stricken floor 10*a* is taken as a3, and the travel time periods during which the car 3 moves to the floors 10*d* are taken as a4 to an. In FIG. 1, the travel time periods a2 and a3 are shown schematically.

After Step S4, the process proceeds to Step S5. In Step S5, based on the information concerning the presence and absence of person at each floor, the number of persons, and the position of the person, which is outputted from the person detector 6, the elevator control device body 4 calculates travel time periods b1 to bn necessary for the evacuee 8 at each floor to move to the elevator hall of that floor with respect to each floor. In FIG. 1, the travel time period b1 of the evacuee 8 at the disaster-stricken floor 10*a*, the travel time period b2 of the evacuee 8 at the upper floor 10*b* next to the disaster-stricken floor 10*a*, and the travel time period b3 of the evacuee 8 at the lower floor 10*c* next to the disaster-stricken floor 10*a* are shown schematically.

After Step S5, the process proceeds to Step S6. In Step S6, based on the information concerning the presence and absence of person at each floor, and the number of persons, which is outputted from the person detector 6, the elevator control device body 4 calculates boarding time periods c1 to en necessary for the evacuee 8 at each floor to get into the car 3 from the elevator hall on that floor.

Successively, in Step S7, the elevator control device body 4 calculates travel time periods d1 to do necessary for the car 3 to move from each floor to the floor of the first order of precedence of arrival (hereinafter, this floor is referred to as a priority floor. In this example, the priority floor is the disaster-stricken floor 10*a*). FIG. 1 shows the travel time period d2 during which the car 3 moves from the upper floor 10*b* to the priority floor (the disaster-stricken floor 10*a*).

After Step S7, the process proceeds to Step S8. In Step S8, for each floor other than the priority floor, the sum total of the travel time period during which the car 3 moves from the present position to that floor, which has been calculated in Step S4, the travel time period during which the evacuee 8 at that floor moves to the hall, which has been calculated in Step S5, the boarding time period during which the evacuee 8 at that floor gets into the car 3, which has been calculated in Step S6, and the travel time period during which the car 3 moves from that floor to the priority floor, which has been calculated in Step S7, is compared with the travel time period during which the evacuee 8 at the priority floor moves to the hall, which has been calculated in Step S5.

That is, taking x as 2 to n, it is checked one after another whether or not x, for which the sum total of the travel time period ax of the car 3, the travel time period bx of the evacuee 8, the boarding time period cx of the evacuee 8, and travel time period dx of the car 3 to the priority floor is smaller than travel time period b1 of the evacuee 8 at the priority floor (the formula of $ax+bx+cx+dx<b1$ holds), exists. If x for which the formula of $ax+bx+cx+dx<b1$ holds is found in Step S8, the process proceeds to Step S9.

In Step S9, the elevator control device body 4 changes the floor corresponding to x for which it has been checked in Step S8 that the formula of $ax+bx+cx+dx<b1$ holds to a priority floor of the first order of precedence of arrival. Then, in Step S10, the elevator control device body 4 updates the evacuation operation plan based on the changed order of precedence of arrival. After Step S10, the process proceeds to Step S11. On the other hand, if x for which the formula of $ax+bx+cx+dx<b1$ holds is not found in Step S8, the priority floor and the evacuation operation plan need not be updated, so that the process proceeds to Step S11 omitting Steps S9 and S10.

In Step S11, the elevator control device body 4 controls the running of the car 3 pursuant to the evacuation operation plan to carry the evacuee 8 to the escape floor 9. Then, the elevator control device body 4 makes a check whether or not all evacuees 8 have been carried to the escape floor 9 and the evacuation has been completed. If it is checked in Step S11 that the evacuation has not yet been completed, the process returns to Step S4, and the operations in Step S4 through Step S11 is repeated. On the other hand, if it is checked in Step S11 that the evacuation has been completed, the evacuation operation mode is finished.

From the fire detector 5 and the person detector 6, the damage information and the information concerning the number of persons and the position of person are outputted, respectively, at every predetermined time intervals. Therefore, the evacuation operation plan in the elevator control device body 4 is also updated at the every predetermined time intervals, whereby the emergency evacuation operation can be carried out according to the situation changing in succession. Also, the elevator control device body 4 may consider the situation of call registration at each floor in developing the evacuation operation plan.

In this embodiment, an example in which the fire detector 5 that detects damage due to fire is used has been explained. However, the detected damage is not limited to damage due to fire, and a detector that detects damage due to earthquake may be used. That is, as the fire detector 5, a damage detector that detects damage due to disaster such as fire and earthquake and outputs the detected damage as damage information of each floor can be used.

Further, in the case where, as the person detector 6, there is adopted an apparatus that detects the number of persons at each floor, the position of person, and the like by receiving a signal sent from a wireless transmitter carried by respective persons at each floor, information concerning the name, age, presence and absence of physical handicap, room number, and the like of the person carrying that wireless transmitter may be stored in advance in the wireless transmitter. In other words, this wireless transmitter is a non-contact data carrier that stores information data such as name in advance.

The wire transmitter transmits the information concerning the name, age, presence and absence of physical handicap, room number, and the like as a signal. The person detector 6 sends the information received from the wireless transmitter, together with the information concerning the presence and absence of person at each floor, the number of persons, and the position of the person, to the elevator control device body 4. When calculating the travel time period of the evacuee 8 to the hall and the boarding time period into the car 3, based on the information sent from the person detector 6, the elevator control device body 4 calculates the transfer time period and boarding time period of person by using at least one piece of information concerning the name, age, presence and absence of physical handicap, room number, and the like in addition to the information concerning the presence and absence of person at each floor, the number of persons, and the position of the person outputted from the person detector 6. By this configuration, the transfer time period and the boarding time period can be calculated more exactly.

The elevator control device configured as described above includes the fire detector, which is a damage detector that detects damage due to disaster at each floor and outputs the detected damage as damage information, and the person detector that detects the number of persons present at each floor and the position of the person and outputs these pieces of data as person number and position information. In the emergency evacuation operation, the elevator control device body establishes the elevator evacuation operation plan based on the position of the car, the damage information, and the person number and position information, and controls the operation of elevator based on the developed evacuation operation plan. Therefore, in the emergency evacuation operation at the time of disaster occurrence, (the car of) the elevator can be operated optimally so that the evacuation can be completed in the shortest time period.

INDUSTRIAL APPLICABILITY

The present invention can be applied to an elevator control device that has a control device body for controlling the operation of one or more elevators operated between the plurality of floors of a building, and carries out emergency evacuation operation for evacuating the people in the building by using an elevator when the building suffers from fire, earthquake, or the like.

DESCRIPTION OF SYMBOLS

1 building
2 shaft
3 car
4 elevator control device body
5 fire detector
6 person detector
7 fire
8 evacuee
9 escape floor
10*a* disaster-stricken floor
10*b* upper floor
10*c* lower floor
10*d* other remaining floors

The invention claimed is:

1. An elevator control device which has a control device body for controlling operation of one or more elevators operated between a plurality of floors of a building, and carries out emergency evacuation operation for evacuating the people in the building by using the elevator when the building suffers from an emergency, the elevator control device comprising:

a damage detector which detects damage due to disaster at each floor and outputs the detected damage as damage information of each floor; and a person detector which detects a number of persons present at each floor and a position of the person and outputs these pieces of data as person number and position information, and in the emergency evacuation operation, on the basis of the person number and position information, the control device body calculates a travel time period necessary for a person present at the floor to move to the elevator hall of that floor and a boarding time period necessary for the person to get into the elevator car from the hall when the elevator car arrives at that floor, and on the basis of the travel time period, boarding time period, the position of the elevator car and the damage information, the control device body develops the evacuation operation plan so that the emergency evacuation operation to an escape floor is completed in a shortest time period, and controls the elevator operation on the basis of the developed evacuation operation plan.

2. The elevator control device according to claim 1, wherein the damage information comprises three stages of damage level of a first level which is a damage level at the initial stage, a second level which is a damage level at which the people must get away urgently, and a third level which is a damage level at which the people cannot get away by using the elevator; and in developing the evacuation operation plan, the control device body gives priority so an order of precedence of elevator arrival at floor in which the damage level is the second level, is a high level order.

3. The elevator control device according to claim 1, wherein the elevator control device comprises a wireless transmitter which is carried by each person, stores, in advance, information concerning one or more of the name, age, presence and absence of physical handicap, and room number of that person, and outputs this information as a wireless signal;

by using the received wireless signal, the person detector detects the number of persons present at each floor and the position of the person, and outputs the person number and position information and the information obtained from the wireless signal; and on the basis of the person number and position information and the information obtained from the wireless signal, the control device body calculates the travel time period or the boarding time period.

4. The elevator control device according to claim 2, wherein the elevator control device comprises a wireless transmitter which is carried by each person, stores, in advance, information concerning one or more of the name, age, presence and absence of physical handicap, and room number of that person, and outputs this information as a wireless signal;

by using the received wireless signal, the person detector detects the number of persons present at each floor and the position of the person, and outputs the person number and position information and the information obtained from the wireless signal; and on the basis of the person number and position information and the information obtained from the wireless signal, the control device body calculates the travel time period or the boarding time period.

5. The elevator control device according to claim 1, wherein the damage detector outputs the damage information at every of predetermined time intervals;

the person detector outputs the person number and position information at the every predetermined time intervals; and the control device body updates the evacuation operation plan at the every predetermined time intervals.

6. The elevator control device according to claim 2, wherein the damage detector outputs the damage information at every of predetermined time intervals;

the person detector outputs the person number and position information at the every predetermined time intervals; and the control device body updates the evacuation operation plan at the every predetermined time intervals.

7. The elevator control device according to claim 3, wherein the damage detector outputs the damage information at every of predetermined time intervals;

the person detector outputs the person number and position information at the every predetermined time intervals; and the control device body updates the evacuation operation plan at the every predetermined time intervals.

8. The elevator control device according to claim 4, wherein the damage detector outputs the damage information at every of predetermined time intervals;

the person detector outputs the person number and position information at the every predetermined time intervals; and the control device body updates the evacuation operation plan at the every predetermined time intervals.

* * * * *